US007197151B1

(12) United States Patent
Sibbald et al.

(10) Patent No.: US 7,197,151 B1
(45) Date of Patent: Mar. 27, 2007

(54) METHOD OF IMPROVING 3D SOUND REPRODUCTION

(75) Inventors: Alastair Sibbald, Maidenhead (GB); Richard David Clemow, Gerrards Cross (GB); Fawad Nackvi, Southall (GB)

(73) Assignee: Creative Technology Ltd, Singapore (SG)

( * ) Notice: Subject to any disclaimer, the term of this patent is extended or adjusted under 35 U.S.C. 154(b) by 0 days.

(21) Appl. No.: 09/270,768

(22) Filed: Mar. 17, 1999

(30) Foreign Application Priority Data

Mar. 17, 1998 (GB) ..... 9805534.6

(51) Int. Cl.
*H04R 5/02* (2006.01)
*H04R 5/00* (2006.01)

(52) U.S. Cl. ..... 381/310; 381/309; 381/17

(58) Field of Classification Search ..... 381/17, 381/98, 101–103, 310, 1, 303, 26, 309, 63
See application file for complete search history.

(56) References Cited

U.S. PATENT DOCUMENTS 3,236,949 A * 2/1966 Atal et al. ..... 381/1
3,970,787 A * 7/1976 Searle ..... 381/310
4,975,954 A * 12/1990 Cooper et al. ..... 381/26
5,386,082 A * 1/1995 Higashi ..... 84/630
5,495,534 A * 2/1996 Inanaga et al. ..... 381/310
5,715,317 A 2/1998 Nakazawa
6,035,045 A * 3/2000 Fujita et al. ..... 381/17
6,078,669 A * 6/2000 Maher ..... 381/17
6,173,061 B1 * 1/2001 Norris et al. ..... 381/309
6,243,476 B1 * 6/2001 Gardner ..... 381/303

FOREIGN PATENT DOCUMENTS

EP 0 827 361 3/1998

* cited by examiner

*Primary Examiner*—Sinh Tran
*Assistant Examiner*—Daniel R. Sellers
(74) *Attorney, Agent, or Firm*—Russell N. Swerdon

(57) ABSTRACT

A method of improving 3D sound reproduction is described, in which virtual sound sources to be positioned behind a listener 10 are filtered using an HF-cut filter in order to remove distracting high-frequency components caused by incomplete transaural crosstalk cancellation. Sound sources placed in the rearward hemisphere of reference sphere 30 are filtered by an amount dependent on the position of the sound source in order to provide a smooth transition between the filtered and unfiltered hemispheres. HF-cut filtering is at a maximum when the sound source is placed directly behind the listener, and is progressively reduced as the forward hemisphere is approached. The invention offers an advantage in that virtual sound images may be placed more effectively behind the listener, given improved realism of 3D effects.

14 Claims, 10 Drawing Sheets

METHOD OF IMPROVING 3D SOUND REPRODUCTION

FIELD OF THE INVENTION

This invention relates to a method of improving three-dimensional (3D) sound reproduction.

BACKGROUND OF THE INVENTION

The processing of binaural (two channel or stereo) audio signals to produce highly realistic 3D sound images is well known, and is described, for example, in International Patent Application No. WO94/22278. Binaural technology is based on recordings made using a so-called "artificial head" microphone system, and the recordings are subsequently processed digitally. The use of the artificial head ensures that the natural 3D sound cues—which the brain uses to determine the position of sound sources in 3D space—are incorporated into the stereo recordings.

The 3D sound cues are introduced naturally by the head and ears when we listen to sounds in real life, and they include the following characteristics: inter-aural amplitude difference (LAD), inter-aural time difference (ITD) and spectral shaping by the outer ear. To set the position of a virtual sound source, separate audio filters for the left and right channels of the audio signal add these characteristics, depending on the desired position of the sound. The characteristics themselves are determined by measurement of the head-related transfer function (HRTF). The HRTF characterises the modifications which an audio signal undergoes on its path from a point in space, at a defined direction and distance from a listener, to the eardrums of the listener.

When a pair of audio signals incorporating such 3D sound cues are introduced efficiently into the ears of the listener, by headphones say, then he or she perceives a virtual sound source to be located at the associated position in 3D space. However, if the processed signals are not conveyed directly and efficiently into the ears of the listener, then the full 3D effects will not be perceived. For example, when listening to sounds via conventional stereo loudspeakers, the left ear hears a little of the right loudspeaker signal, and vice versa—this is known as transaural crosstalk. By cancelling out transaural crosstalk, full 3D effects can be enjoyed via loudspeakers remote from the listener. Transaural crosstalk from each of the loudspeakers may be cancelled by creating appropriate crosstalk cancellation signals from the opposite loudspeaker. Crosstalk cancellation signals are equal in magnitude and inverted (opposite in polarity) with respect to the transaural crosstalk signals.

The acoustic effects of transaural crosstalk may be illustrated by means of a practical example illustrated by FIG. 1. Suppose that a sound recording is made using a pair of microphones spaced one head-width (approximately 15 cm) apart. A sound source 16 is now placed immediately to the left (azimuth −90°) of the microphone configuration. When the sound source 16 emits a sound impulse, the impulse arrives at the left-hand microphone first, and so it is recorded by the left-hand microphone before it is recorded by the right-hand microphone. The relative time-of-arrival delay for the sound impulse, $t_w$, reaching the right-hand microphone is approximately 437 μs, and is equal to the separation distance (15 cm) divided by the speed of sound in air (approximately 343 $ms^{-1}$). In practice, although the ears are separated by one head-width, the sound waves have to diffract around the circumference of the head, and therefore the effective path length is greater; it can be approximated by the expression:

$$\left(\frac{\theta}{360}\right)2\pi r + r\cdot\sin\theta,$$

where r is the radius of the head, and θ is the azimuth angle of the sound source.

Suppose, now, that this recording is being replayed on a two-speaker audio system, and that a listener 10 is sitting in the position shown in FIG. 1. Under these circumstances, with the speakers 12 and 14 located at angles of about ±30° with respect to the listener, the inter-aural time difference between signals arriving at the left and right ears, $t_e$, will be approximately 250 μs. When the recording of the impulse is replayed, it is emitted first from the left loudspeaker 12, followed by the right-hand loudspeaker 14 after the recorded delay of 437 μs.

Referring to FIG. 1, first the left ear hears the primary sound W from the left-hand loudspeaker 12, but then the crosstalk X from the left speaker arrives at the right ear only 250 μs ($t_e$) afterwards. Because this crosstalk signal derives from the same, real sound source, the brain receives a pair of highly correlated left and right sound signals, which it immediately uses to determine where the recorded sound source is apparently located. The brain therefore receives an ITD of only 250 μs (instead of 437 μs), which corresponds to the actual position of the left-hand loudspeaker at −30° azimuth. Consequently, the brain incorrectly localizes the sound source at −30°, rather than its correct location of −90° azimuth. The transaural crosstalk has, in effect, disabled the time-domain information which was built into the recording.

If transaural crosstalk cancellation is carried out correctly, and high quality HRTF source data is used, then the effects on the listener can be quite remarkable. For example, it is possible to move a virtual sound source around the listener in a complete circle, beginning in front (0° azimuth), moving around the right-hand side of the listener (+90° azimuth), then behind the listener (±180° azimuth), and back around the left-hand side (−90° azimuth) to the front again. It is also possible to make the virtual sound source appear to move in a vertical circle around the listener, and indeed make the sound appear to come from any selected position in space.

However, some positions are more difficult to synthesise than others. For example, the effectiveness of moving a virtual sound source directly upwards or downwards is greater at the sides of the listener (±90° azimuth) than directly in front of the listener (0° azimuth). This is probably because there is more left-right difference information for the brain to work with. Similarly, it is difficult to differentiate between a sound source directly in front of the listener (0° azimuth), and a source directly behind the listener (±180° azimuth). This is because there is no time-domain information present for the brain to operate with (that is, the ITD=0), and the only other positional information available to the brain, spectral data, is similar in both of these positions.

In practice, there is more high frequency energy perceived when the sound source is in front of the listener. This is because the high frequencies from frontal sources are reflected into the auditory canal from the rear wall of the concha, whereas for a rearward source, high frequencies cannot diffract around the pinna sufficiently (FIG. 12).

One of the first practical crosstalk cancellation schemes was described in the US patent of Atal and Schroeder (U.S.

Pat. No. 3,236,949), and more fully explained in Schroeder's 1975 publication "Models of Hearing" (Proc. IEEE, September 1975, 63 (9), pp. 1332–1350). A block diagram of this method is shown in FIG. 2.

Referring to FIG. 2, there are binaural sound sources 18 (left) and 20 (right), which are filtered by crossfeed filters 21 and 23 to generate loudspeaker driving signals 22 and 24 respectively. The filters 21 and 23 represent the combination of two basic functions: firstly, the transfer function, S, between a first loudspeaker of a pair of loudspeakers and the ear of a listener 10 which is closest to this loudspeaker; and secondly, a function, A, representing the transfer function from the same first loudspeaker to the far ear of the listener. If there were no transaural crosstalk present, the transfer function from the right sound source 20 to the right ear (and from the left source 18 to the left ear) would be simply S. The presence of transaural crosstalk, however, requires a cancellation signal to be provided by the other loudspeaker.

For example, consider the process of transferring the right channel signal 20 into the right ear only. The transfer from the right loudspeaker 14 to the right ear is via the "same-side" function S. The crosstalk from the right loudspeaker will arrive at the left ear with transfer function A. Consequently, we need to deliver a (−A) signal to the left ear from the left speaker 12 in order to cancel it. However, we know that the transfer function from the left speaker to the left ear is S, and so the overall crosstalk cancellation signal from the right to left channel must be (−A/S). This would deliver the correct crosstalk cancellation signal properly to the left ear. Thus, according to these observations, the crossfeed function, C, must be set equal to (−A/S). S and A can be established by direct measurement, ideally from an artificial head having physical features and dimensions of an average human head.

However, a perfect crosstalk cancellation system is only obtained when the head of a listener is totally immobile and fixed in the absolute centre of the preferred position (i.e., the "sweet spot", where the ears are exactly coincident with the respective sound-wave cancellation nodes). The reason for this is that sound-wave cancellation effects are dependent on the precise coincidence of equal and opposite signals, and so when one wave is relatively displaced, then the wave cancellation is incomplete.

For example, if a listener's head were to move sideways such that the left ear was 5 cm closer to the left speaker (and 5 cm more distant from the right loudspeaker), then the unwanted primary signal to the left ear (from the right speaker) which must be cancelled, would be shifted relatively by 10 cm with respect to its intended cancellation wave from the left speaker. Thus the transaural crosstalk cancellation would be imperfect. As the frequency of the audio signal increases, this effect occurs for smaller relative lateral movements, because the nodes and anti-nodes become closer and closer.

U.S. Pat. No. 4,975,954 (Cooper and Bauck) discloses a particular transaural crosstalk cancellation scheme as shown in FIG. 3. The scheme features a pair of high frequency (HF) cut (>8 kHz) filters 26 and 28. In this method, the high frequency signals being fed to the crosstalk cancellation means are attenuated by low-pass filters 26 and 28 situated in the crossfeed filter path 8 from the left to the right channel (and vice versa). Consequently, it is claimed that imperfect crosstalk cancellation at high frequencies due to the movement of the head out of the preferred position would be reduced because such high frequencies are not being transaural crosstalk-cancelled.

However, this method is ineffective for rearward placement of virtual sound sources because the high frequency components in the source signals 18 and 20 are transmitted directly to the loudspeakers themselves, without crosstalk cancellation. Consequently, the perceived sources of the HF sounds are the loudspeakers themselves, rather than one or more virtual sound sources. As a result, the HF sounds appear to be detached from the virtual sound images, and create a frontal spatial distraction. When the virtual sound image is to be positioned in the front of the listener, the effect of this scheme is to smear out the spatial position of the sound image, but when the virtual sound image is to be positioned behind the listener, the effect inhibits and prevents the formation of a rearward image. Instead, the image becomes reflected in front of the listener.

In respect of other crosstalk cancellation schemes, such as that of Atal and Schroeder, in practical situations a listener's head cannot be guaranteed to remain in the preferred position, and if it moves from this preferred position, the transaural crosstalk cancellation will not be perfect. The effect of imperfect crosstalk cancellation at the higher frequencies is that they appear to originate from the loudspeakers themselves, and not from the required position in which the virtual sound source was placed using the HRTFs, as noted above. This makes locating a virtual sound image behind the listener much more difficult to achieve especially because, as stated previously, it is the higher frequency sound information which provides a frontal cue and enables a listener to distinguish between sounds placed in front and sounds placed behind.

It is worth noting at this stage that the creation of effective crosstalk cancellation is not so difficult as it might appear. This is because of the natural acoustic properties of the head and ears themselves. In essence, as the frequency of a signal increases, the head acts more and more effectively as a baffle, naturally suppressing crosstalk at high frequencies. Consequently, there is little crosstalk to cancel at high frequencies, and the method of Cooper and Bauck does not provide, in practice, a significant advantage over the Atal and Schroeder method.

SUMMARY OF THE INVENTION

An aim of the present invention is to provide more effective 3D-sound processing by reducing distracting high-frequency components of a virtual sound source positioned behind a listener, preferably by the use of progressive HF-cut filtering.

According to a first aspect of the invention there is provided a method of processing a single channel audio signal to provide an audio signal having left and right channels corresponding to a virtual sound source at a given direction in space relative to a preferred position of a listener in use, the space including a forward hemisphere and a rearward hemisphere relative to said preferred position, the information in the channels including cues for perception of the direction of said single channel audio signal from said preferred position, the method including the steps of: i) providing a two channel signal having the same single channel signal in the two channels; ii) modifying the two channel signal by modifying both of the channels using one of a plurality of head response transfer functions to provide a right signal in one channel for the right ear of a listener and a left signal in the other channel for the left ear of the listener; iii) introducing a time delay between the channels corresponding to the inter-aural time difference for a signal coming from said given direction, characterised in that the method further includes filtering the signal in both channels using high frequency (HF) cut filter means, the filter characteristics of the HF-cut filter means being settable according to the given direction of the virtual sound source.

Preferably the amount of HF-cut filtering is at a maximum for virtual sound sources placed directly behind the preferred position of the listener, that is, at a direction of azimuth ±180° and elevation 0° relative to the preferred position of the listener, and the amount of HF-cut filtering progressively decreases as the forward hemisphere is approached.

Preferably there is zero HF-cut filtering for virtual sound sources placed at directions of azimuth between 0° and ±90°, relative to the preferred position of the listener.

The left and right channel signals are preferably processed by transaural crosstalk cancellation means in order to give loudspeaker compatible signals.

The coefficients of the HF-cut filter means are advantageously set according to a function of the angle of azimuth and the angle of elevation of the virtual sound source.

Preferably the amount of HF-cut filtering is substantially the same for virtual sound sources placed at positions on the rear hemisphere which are equidistant from azimuth ±180° and elevation 0° relative to the preferred position of the listener.

The coefficients of the HF-cut filter means may be set via a look-up table.

The HF-cut filter means may be used in series with an HRTF.

An HRTF may be convolved with an HF-cut filter means to produce a modified HRTF.

According to a second aspect of the invention there is provided an apparatus for performing the aforedescribed method including signal processing means, HRTF filter means, HF-cut filter means, and a means for determining HF-cut filter coefficients as a function of the direction of the virtual sound source.

According to a further aspect of the invention there is provided a computer program for implementing the aforedescribed method.

According to another aspect of the invention there is provided an audio signal processed using the aforedescribed method.

Other objects, advantages and novel features of the present invention will become apparent from the following detailed description of the invention when considered in conjunction with the accompanying drawings.

BRIEF DESCRIPTION OF THE DRAWINGS

A number of embodiments of the invention will now be described, by way of example only, with reference to the accompanying Figures, in which:—

DETAILED DESCRIPTION OF THE PREFERRED EMBODIMENTS

By way of extensive experimentation, the inventors have discovered that in order to enable effective placement of a virtual sound source behind a listener from a pair of conventional loudspeakers, high frequency (HF) components of the virtual sound source which are not crosstalk-cancelled (or which are inadequately crosstalk-cancelled) must be reduced or eliminated in an appropriate manner. These HF components are perceived to emanate from frontal locations and are distracting for the listener.

As stated previously, another reason for reducing the HF components of virtual sound sources to be positioned behind the listener, is that, in practice, such components of a rearward sound source are obstructed from reaching the auditory canal by the pinna, and their magnitude is therefore reduced for rearward sound sources. One way of reducing HF components is to apply a global high-frequency (HF) reduction to the entire audio chain. This, however, would not be a solution, because this would not change the differential spectral data which enables the listener to discriminate between frontal and rearward sources.

The method of the present invention reduces HF components by employing an HF-cut filter for all virtual sound sources which are to be placed behind the listener. In order to create a seamless transition from non-filtered virtual sound sources in front of the listener, to the filtered virtual sound sources behind the listener, we progressively introduce an HF-cut for virtual sounds placed behind the listener's preferred position, increasing the filtering effect the nearer one approaches an azimuth of ±180° (i.e., directly behind the listener). This method operates progressively and smoothly in three dimensions, not just the horizontal plane. It is also capable of reduction to a simple algorithm which may be implemented in the form of a "look-up" table rather than mathematical equations involving transcendental functions, because the latter require considerable computational effort.

Figure 1:
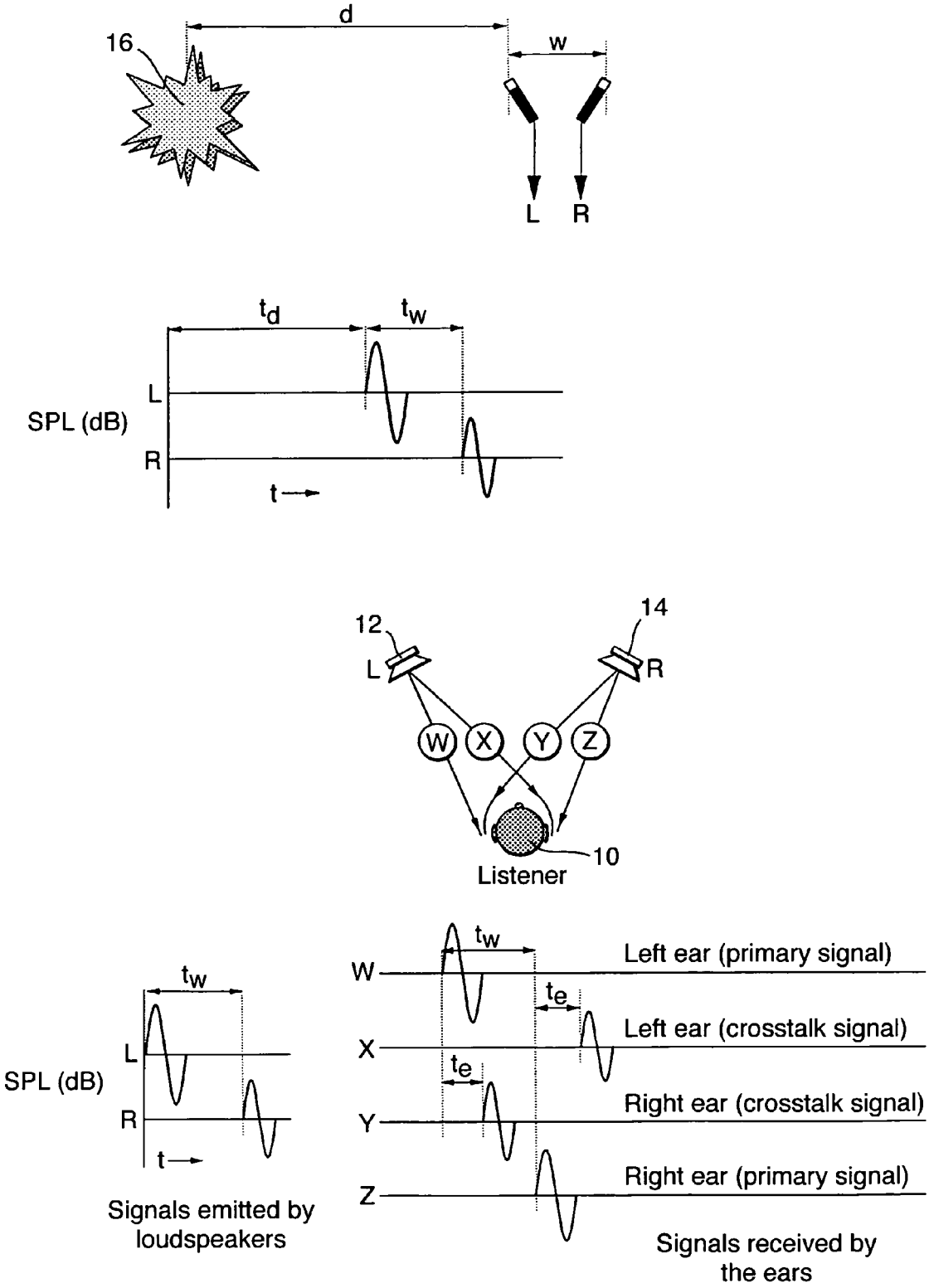
FIG. 1 shows the recording of an event with spaced microphones.
Figure 3:
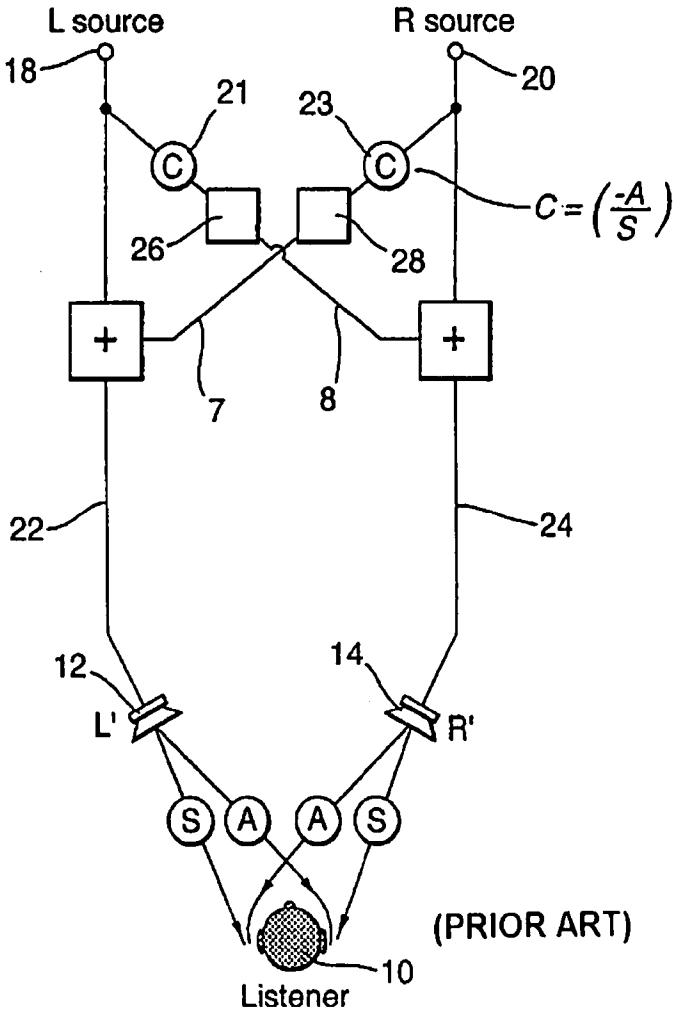
FIGS. 2 and 3 show the transaural crosstalk-cancellation schemes of Schroeder and Cooper & Bauck, respectively (prior art)
Figure 2:
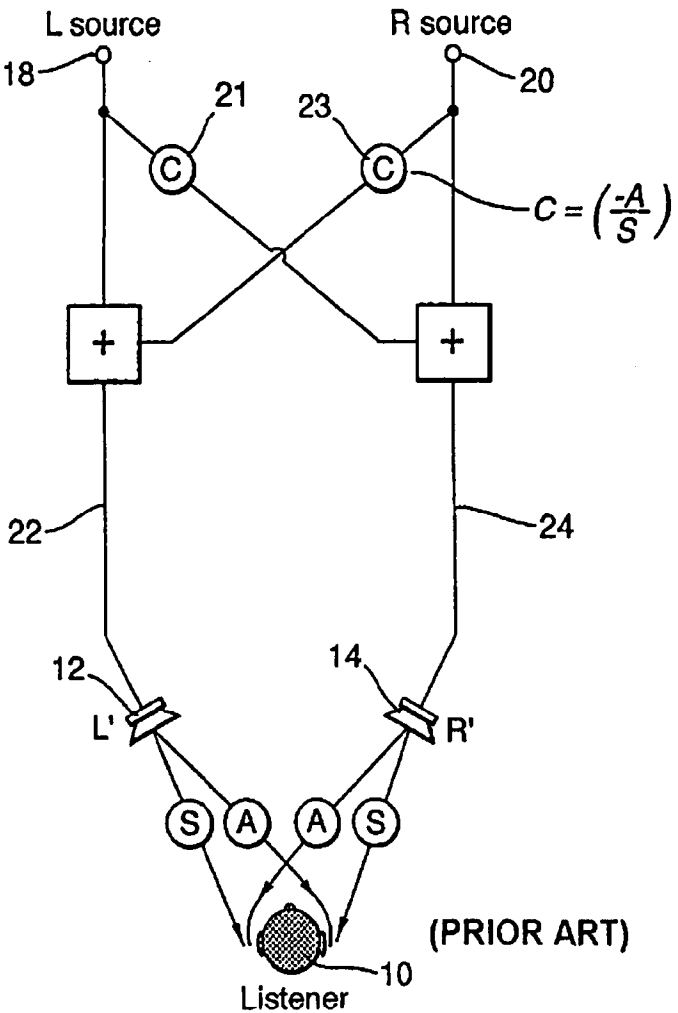
Figure 4:
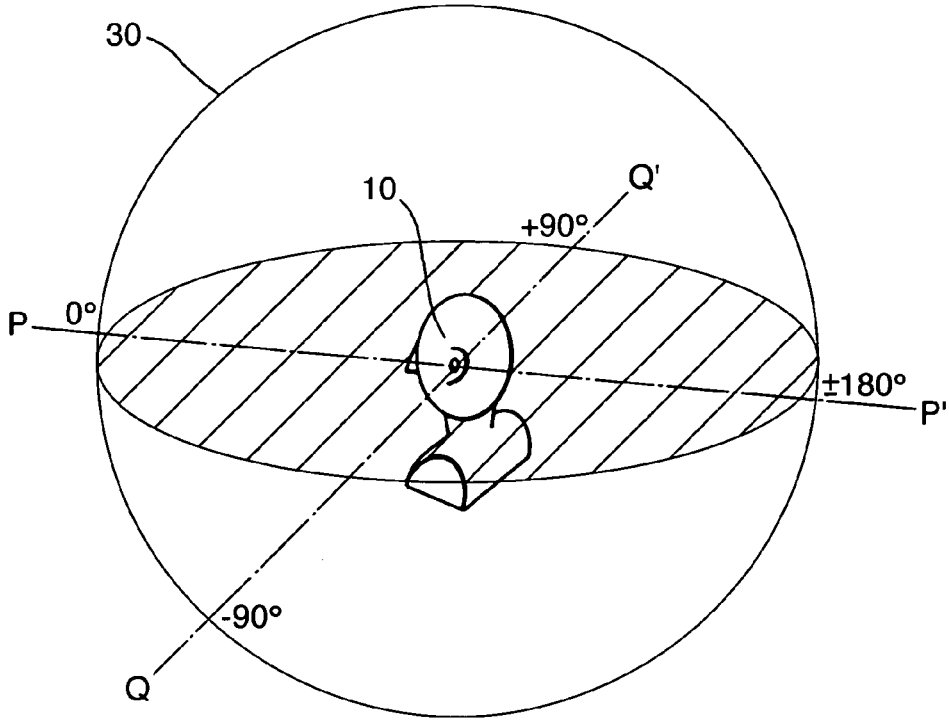
FIG. 4 shows the head of a listener within an imaginary reference sphere, and a co-ordinate system.

These requirements can be fulfilled by the present invention, described as follows, which provides an indexing arrangement for choosing the appropriate HF-cut filter, depending on the values of azimuth and elevation of the virtual sound source chosen. Firstly, a spatial reference system with respect to the listener is defined, as shown in FIG. 4. FIG. 4 depicts the head and shoulders of a listener 10, surrounded by an imaginary reference sphere 30. The horizontal plane cutting the sphere 30 is illustrated by the shaded area, and horizontal axes P–P' and Q–Q' are shown. P–P' is the front-rear axis, and Q–Q' is the lateral axis, both passing through the listener's head.

The convention chosen here for referring to azimuth angles is that they are measured from the frontal pole P towards the rear pole P', with positive values of azimuth on the right-hand side of the listener 10 and negative values on the left-hand side. Rear pole P' is at an azimuth of +180° (and −180°). The median plane is that which bisects the head of the listener vertically in a front-back direction (running along axis P–P'). Angles of elevation are measured directly upwards (or downwards, for negative angles) from the horizontal plane.

Figure 5:
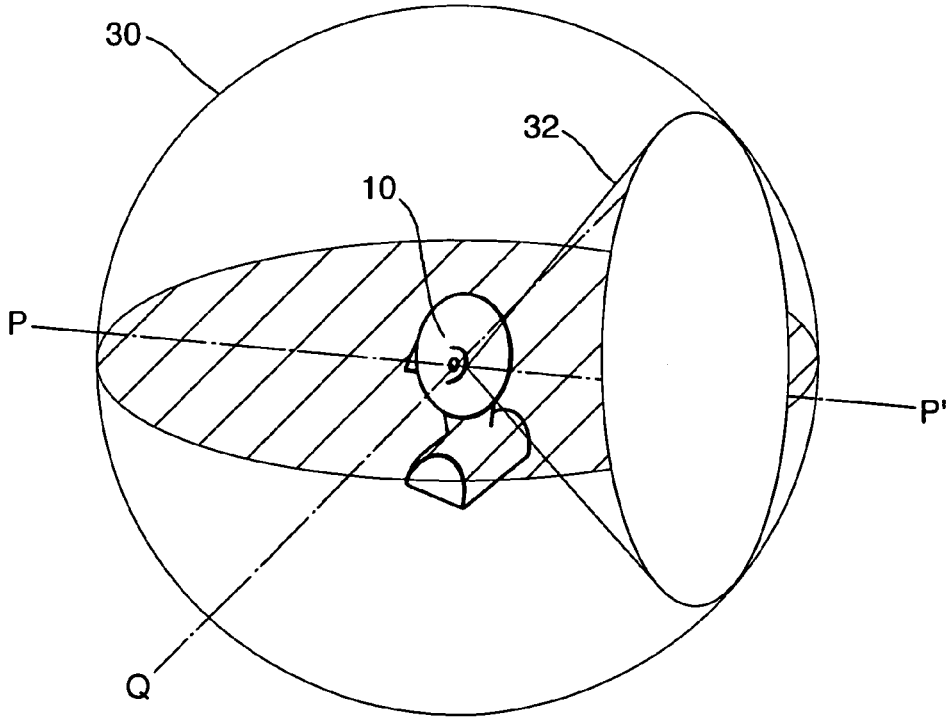
FIG. 5 shows a filtering locus defined by an imaginary cone according to the invention.

FIG. 5 depicts an indexing cone 32 according to the present invention, used to notionally divide the imaginary sphere 30. The indexing cone 32 projects from the origin (the centre of the listener's head) into the space behind the listener 10, aligned axially along axis P–P'. The cone 32 cuts the reference sphere 30 forming a circle of intersection, which we will call the rim of the cone. Either this rim, or the cone itself, can form a locus of points for indexing the HF-cut filtering. That is, all points on the imaginary cone are filtered identically. If the virtual sound source is to be placed on the surface of the hemisphere (i.e., at a given distance from the preferred position of the listener), then all points on the rim of the cone (as defined above) will be filtered identically. It can therefore be seen that the amount of HF-cut filtering is identical for virtual sound sources placed at positions behind the listener which are equidistant from the point P' (±180° azimuth, 0° elevation) on the rear hemisphere.

Figure 6B:
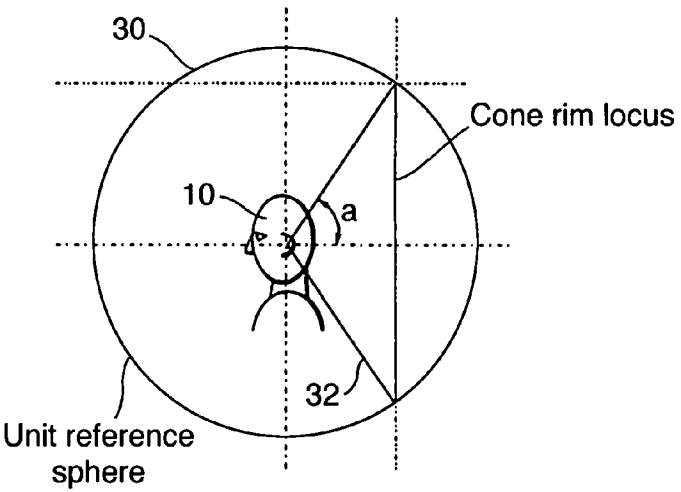
FIGS. 6*a*, 6*b* and 6*c* show the front elevation, end elevation and plan view respectively of FIG. 5 according to the invention.
Figure 6C:
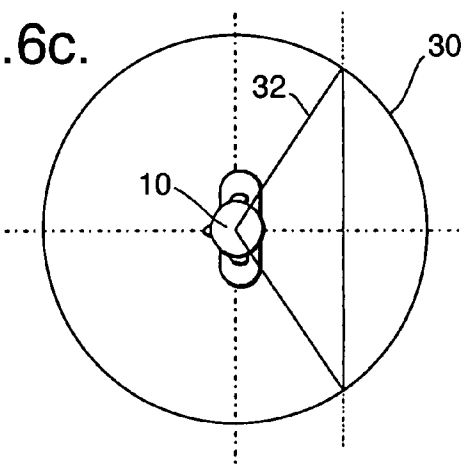
Figure 6A:
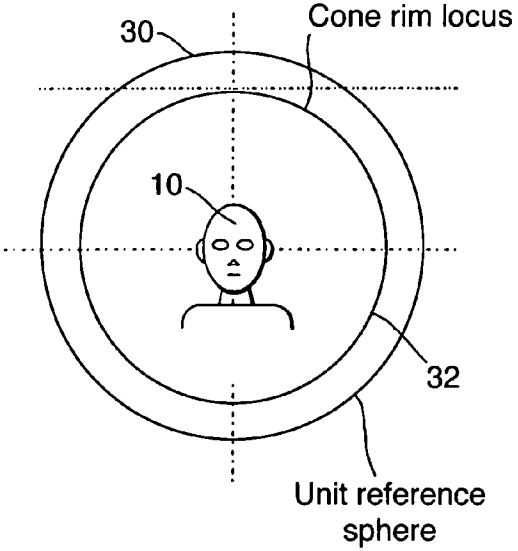

FIG. 6 shows a typical indexing cone 32 according to the invention. More specifically, FIG. 6*a* shows the front elevation, FIG. 6*b* the end elevation, and FIG. 6*c* a plan view of an indexing cone 32. The cone 32 is defined by the cone half-angle a, as shown in FIG. 6*b*. The greater the cone half-angle, the "flatter" the cone.

Figure 7B:
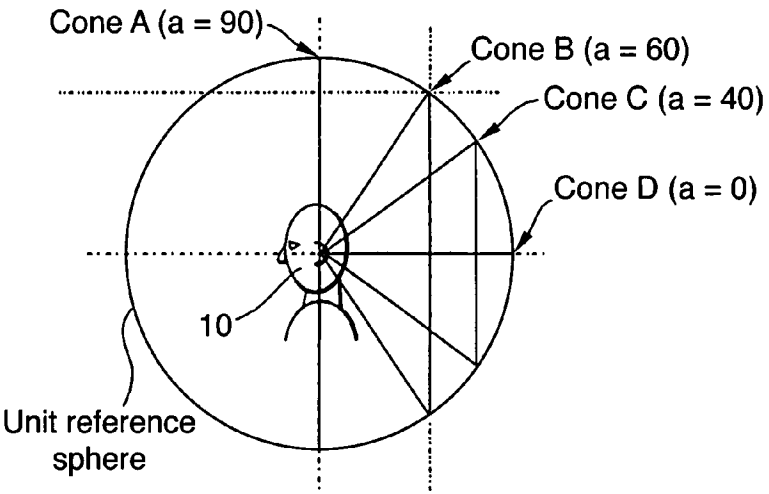
FIGS. 7*a*, 7*b* and 7*c* show the front elevation, end elevation and plan view respectively of a system of imaginary cones for filter indexing according to the invention.
Figure 7C:
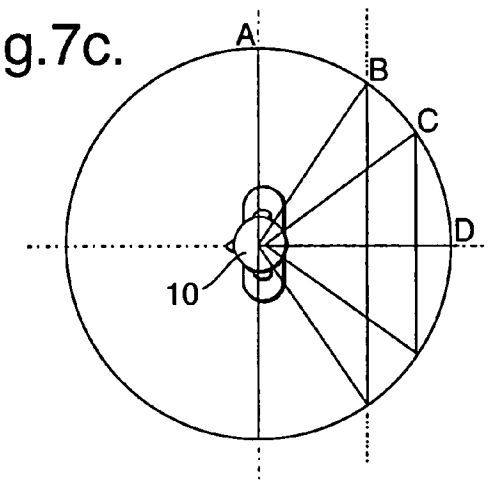
Figure 7A:
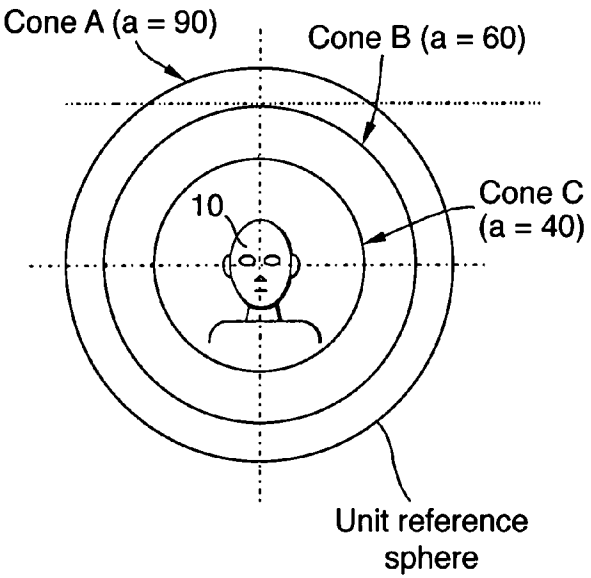

FIG. 7 shows several typical indexing cones according to the invention, including the two limiting conditions: a=0° and a=90°. When a=90° the cone approaches a sheet plane running laterally along axis Q–Q' and bounded by the imaginary reference sphere. This is shown as Cone A in FIG. 7. For a=0°, the cone rim is a single point where axis P–P' intersects the imaginary reference sphere in the rear hemisphere. This is Cone D of FIG. 7.

The indexing cones are used in the following manner. Firstly, a "pole-position" HF-cut filter is chosen for the most extreme rearward position (cone D in FIGS. 7*b* and 7*c*). This is preferably-done by listening to the 3D-sound synthesis system, and gradually introducing appropriate HF-cut filtering until the rear placement of a virtual sound source at azimuth 180° is fully effective for the required lateral movements of the listener's head in the "sweet spot". For example, the pole-position HF-cut filter characteristics may begin to roll-off linearly at 5 kHz, such that the HF cut at 10 kHz is 30 dB. The characteristic of the pole-position HF-cut filter is then notionally divided by a convenient factor (N) to produce a series of N HF-cut filters. Here a factor of 30 is chosen, because, for practical reasons, points on the imaginary sphere from an azimuth of 180° to 90° are quantised, typically, in 3° steps for signal processing. Hence, filter number 30 cuts by 30 dB at 10 kHz and corresponds to maximum HF-cut filtering, filter number 29 cuts by 29 dB at 10 kHz, and so on, down to filter number 1 which cuts by 1 dB at 10 kHz, and corresponds to minimum HF-cut filtering. In practice, a single HF-cut filter is used with settable coefficients corresponding to the characteristics of the series of HF-cut filters described above.

When a virtual sound source is to be placed in the rearward hemisphere, the co-ordinates of its position are used to determine the closest of the (in this case) 30 cone rims. The index number of the cone is then used to select the appropriate HF-cut filter. Referring to virtual sound sources to be placed only in the horizontal plane for the moment, a sound source at the rear pole position P' has an azimuth of 180°, and so would require maximum HF-cut filtering. Therefore filter number 30, cutting by 30 dB, would be used. Moving now to a point with an azimuth of 177°, filter number 29 would be used, and so on, with the minimal filter 1 being used at 93°. This filter-addressing method for the horizontal plane is summarised in Table 1.

TABLE 1

Example of typical horizontal plane indexing arrangements

| Azimuth Angle (Elevation = 0°) | Index Number | HF-cut at 10 kHz (dB) |
|---|---|---|
| — | — | — |
| 84° | — | 0 |
| 87° | — | 0 |
| 90° | — | 0 |
| 93° | 1 | 1 |
| 96° | 2 | 2 |
| 99° | 3 | 3 |
| — | — | — |
| 174° | 28 | 28 |
| 177° | 29 | 29 |
| 180° | 30 | 30 |
| −177° | 29 | 29 |
| −174° | 28 | 28 |
| −171° | 27 | 27 |
| — | — | — |

For points in the horizontal plane, there is a simple relationship between the cone half-angle, a, and the angle of azimuth: they are complementary angles whose sum is always 180°. However, for a virtual sound source at a position lying outside the horizontal plane, the indexing cone is related not only to the angle of azimuth, but also to the angle of elevation. For example, consider an azimuth angle of 180° in the horizontal plane—the indexing number is 30. However, if the azimuth angle were 180° but the angle of elevation 90°, then the spatial position would be directly overhead of the listener, and hence the indexing number would be 0, requiring no filtering. In order to map the spherical co-ordinates to the cone half-angle, an appropriate function must be used. This function will now be described.

Figure 8A:
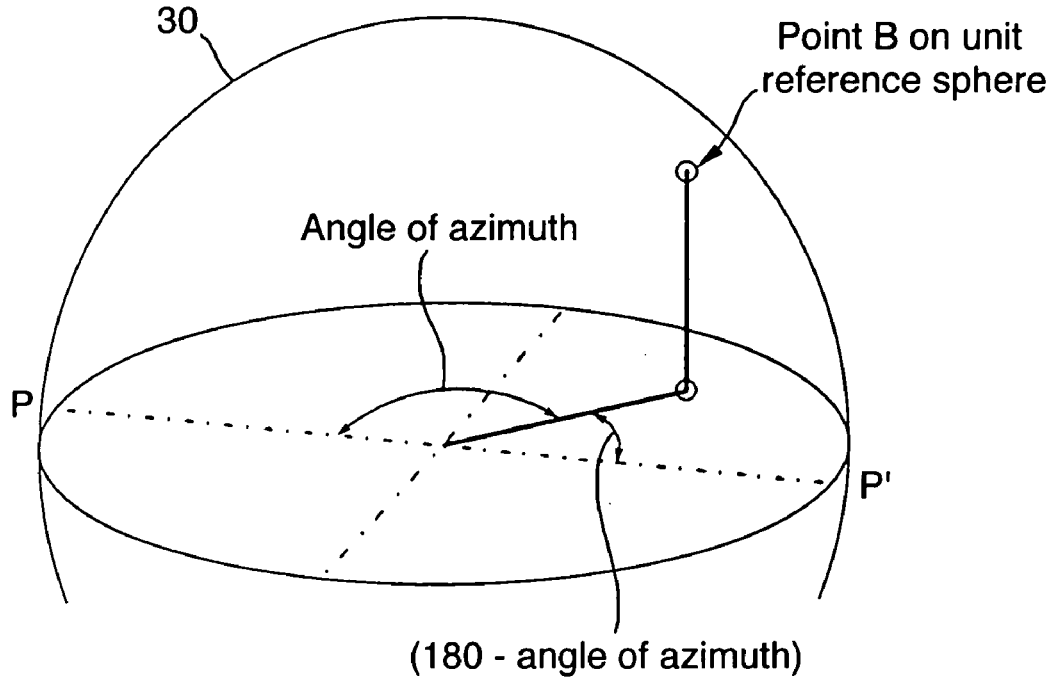
FIG. 8 shows the transformation from spherical co-ordinates to indexing cone according to the invention.
Figure 8B:
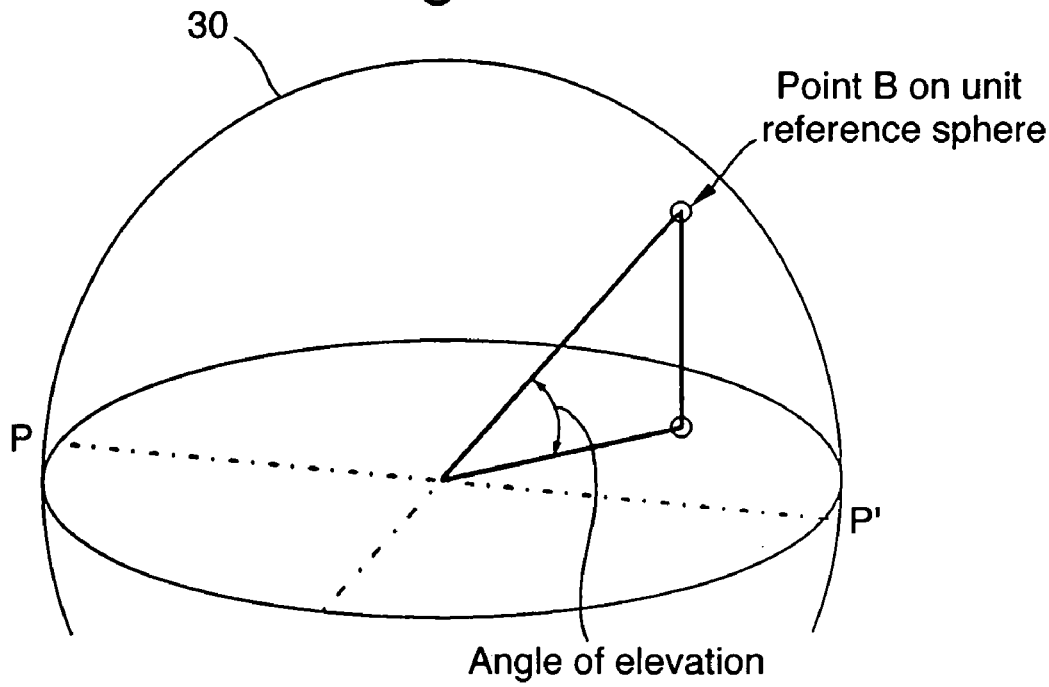

FIGS. 8*a* and 8*b* show a point B on the rearward half of the imaginary reference sphere 30, representing the position in which a virtual sound source is to be placed. FIG. 8*a* shows the angle of azimuth of B, and its relationship with the complementary angle (180°—angle of azimuth). FIG. 8*b* shows the angle of elevation of B, measured with respect to the horizontal plane.

Figure 9:
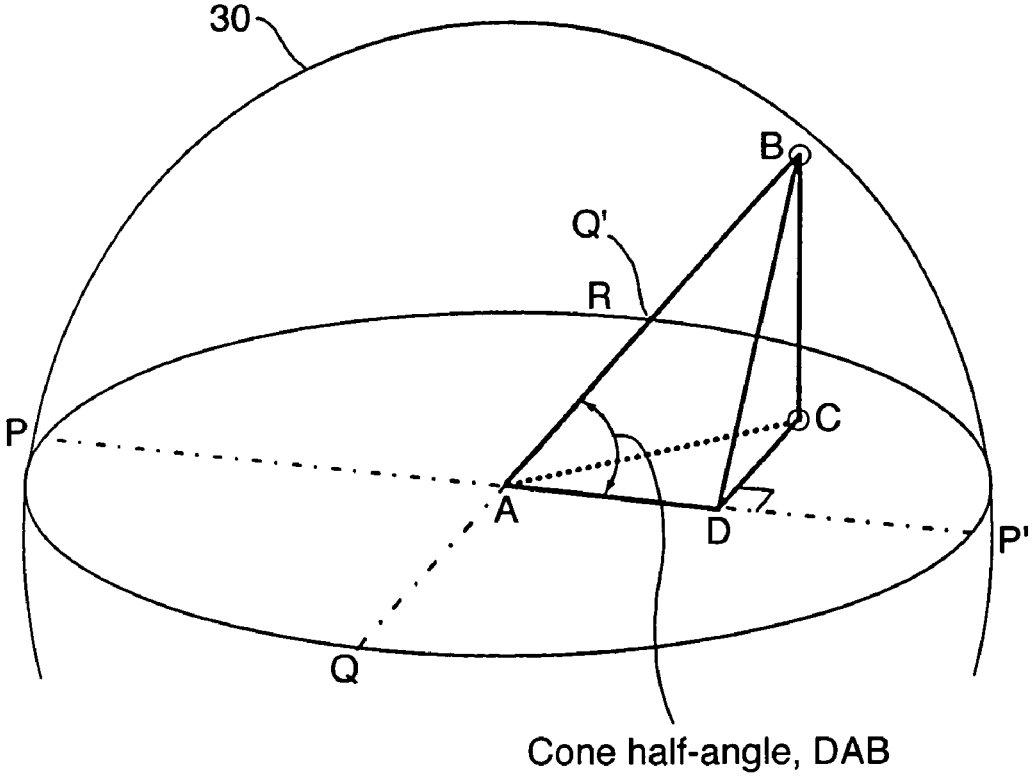
FIG. 9 shows the transformation from spherical co-ordinates to indexing cone transformation according to the invention.

Referring now to FIG. 9, a perpendicular is dropped from B to intersect the horizontal plane at C. A line is constructed from C to join the axis P–P' at D, such that line CD is parallel with the axis Q–Q'. Thus four triangles are formed: ABC, DBC, ABD and ACD. Angle CAB is the angle of elevation, angle CAD is the 180° complement of the azimuth angle, and angle DAB is the cone half-angle.

By inspection of the relationships between the edges of the triangles, it can be shown that the following relationship is found between the cone half-angle a, the angle of azimuth θ, and the angle of elevations ϕ:

$$a = \sin^{-1}\sqrt{(\sin^2\varphi + \cos^2\varphi \cdot \sin^2(180-\theta))} \quad (1)$$

The above function, when applied to values of azimuth and elevation in the rear hemisphere, enables the cone half-angle a to be determined. The value of a may be rounded to, for example, the nearest 3°, enabling the closest indexing cone to be determined. Hence, the index of the filter to be used for the spatial position of point B may be found, as shown in Table 2.

TABLE 2

Example of typical indexing arrangements

| Cone Half-Angle α | Filter Index Number | HF-cut at 10 kHz (dB) |
|---|---|---|
| 90° | — | 0 |
| 87° | 1 | 1 |
| 84° | 2 | 2 |
| 81° | 3 | 3 |
| 78° | 4 | 4 |
| 75° | 5 | 5 |
| — | — | — |
| 6° | 28 | 28 |
| 3° | 29 | 29 |
| 0° | 30 | 30 |

Figure 10:
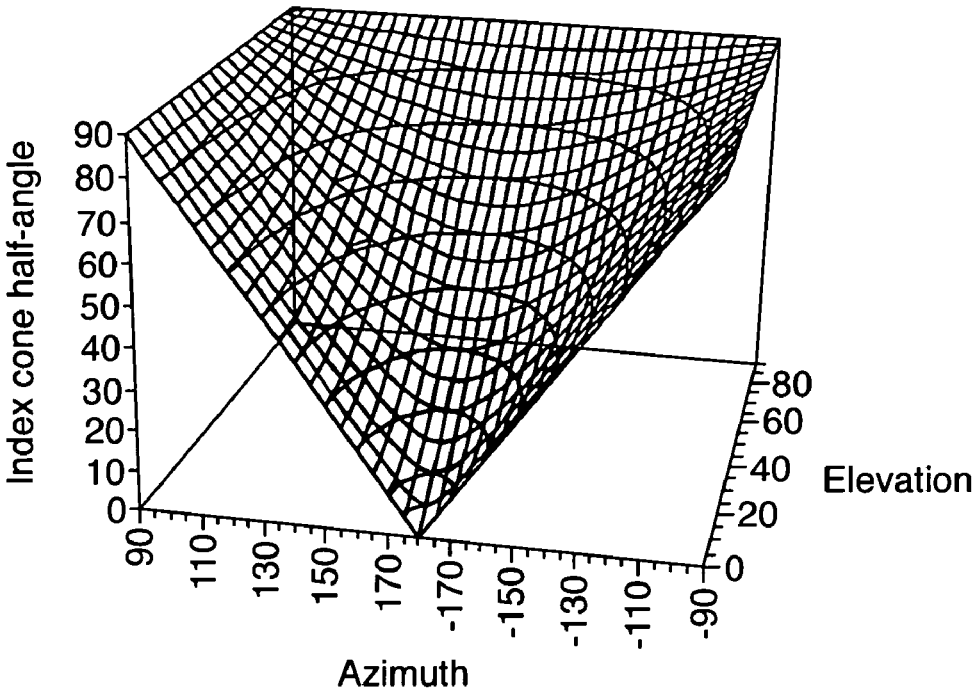
FIGS. 10 and 11 show the surface of the transforms of Equations (1) and (2) respectively, according to the invention.

A 3D surface plot of Equation (1) is shown in FIG. 10.

Equation (1) describes a linear dependency of HF-cut (in dB) on cone half-angle, but it is equally valid to define a non-linear function, for example a logarithmic function, or a power-series expansion. Use of a non-linear function allows the optimisation of the spatial properties of the method. For example, a slowing down of the rate of change of HF-cut is appropriate at the entry point (that is, the position at which filtering begins in the rearward hemisphere), and also at the pole position (180° azimuth), in order to provide a smoother transition effect when moving the virtual sound source through these positions. This is achieved, for example, by the use of appropriately scaled and offset sine and cosine functions. In particular:

$$\text{Index}(\theta, \varphi) = \left[\frac{\cos(2\theta - \pi) + 1}{2}\right]\left[\frac{(\cos 2\varphi) + 1}{2}\right] \quad (2)$$

Figure 11:
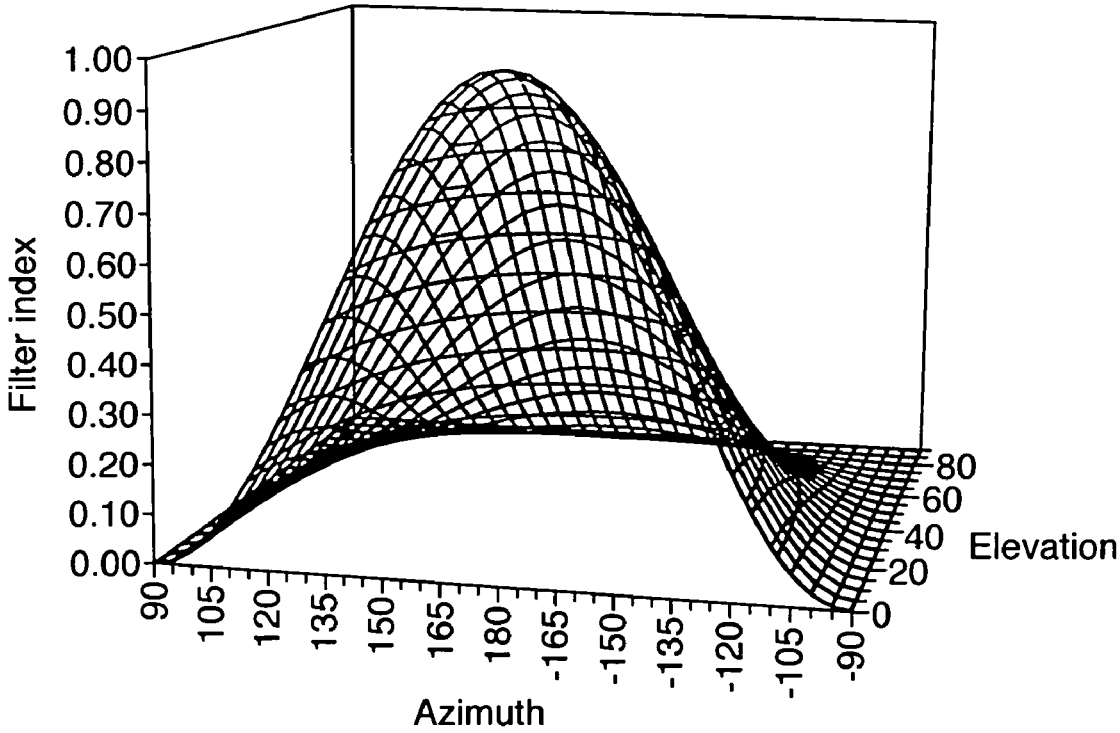
Figure 12:
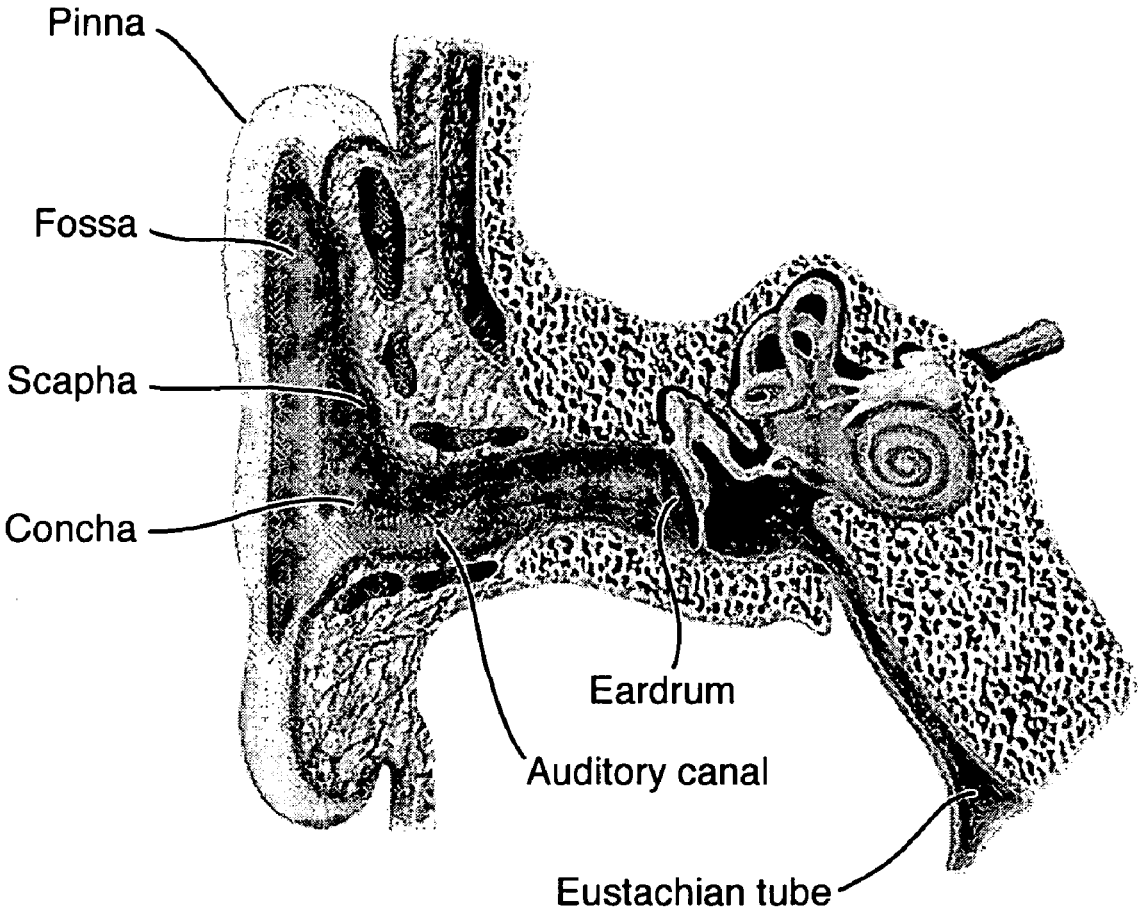
FIG. 12 shows the structure of the outer ear.

Here, θ is the azimuth angle where −90°>θ>+90°, and ϕ is the angle of elevation, lying between 0° and ±90°. Again, the degree of HF cut filtering is directly related to the value of the index. The value of the index lies between 0 (zero filtering) and +1 (maximum filtering), and can be scaled, for example from 1 to 30, to provide the appropriate direct index for filter selection. A three-dimensional plot of the surface of Equation (2) is shown in FIG. 11.

This technique may also be applied to audio signals processed for use with headphones, where cross-talk cancellation is not required. Removing high frequencies from rearward sound sources can reduce the front-back spatial compression of rearward perspectives present when listening through headphones. Reasons for such compression are related to the fact that sound sources rich in high frequency information are perceived by the brain to be located very close to the ears. This is because high frequency sounds are more absorbed by their transmission through air than are low-frequency sounds. When loudspeakers are used for listening, they are usually one or more meters from the ear, whereas when headphones are used for listening, their drive units are in intimate contact with the ear, and so the HF content is unnaturally high. This apparent elevated HF content corresponds to close sound sources, and so the resultant sound image via headphones is constrained so as to be close to the head, and not at the correct distance.

Figure 13:
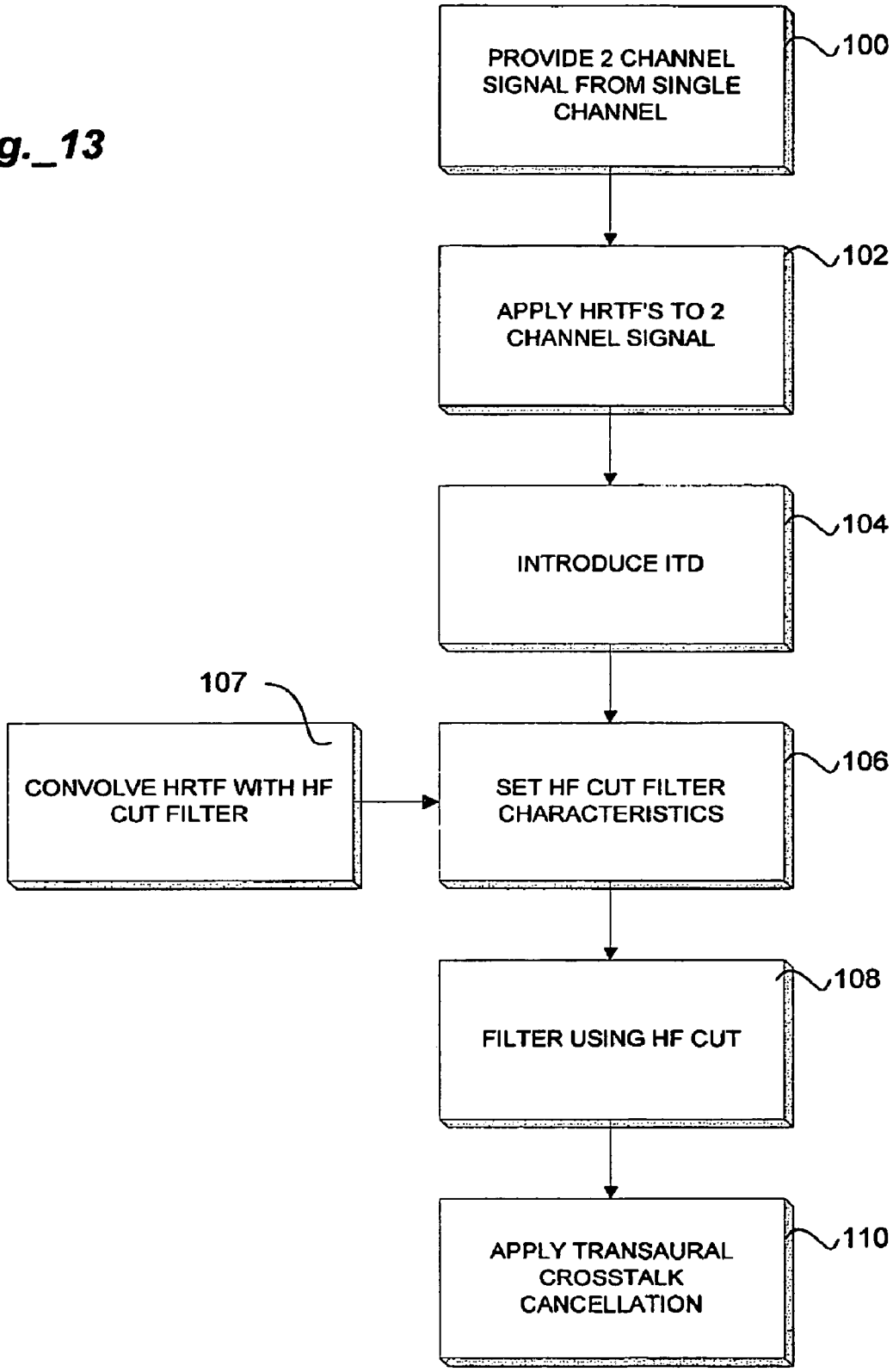
FIG. 13 shows a block diagram of the method of the invention.

A block diagram of the method of the invention is shown in FIG. 13. The method processes a single channel audio signal to provide an audio signal having left and right channels corresponding to a virtual sound source at a given direction in space relative to preferred position of a listener in use. The space includes a forward hemisphere and a rearward hemisphere relative to the preferred position of the listener. The information in the channels includes cues for perception of the direction of the single channel audio signal from the listener's preferred position.

The method includes the steps of: i) providing a two channel signal having the same single channel signal in the two channels (100); ii) modifying the two channel signal by modifying both of the channels using one of a plurality of head response transfer functions (HRTFs) to provide a right signal in one channel for the right ear of a listener, and a left signal in the other channel for the left ear of the listener (102); iii) introducing a time delay between the channels corresponding to the inter-aural time difference for a signal coming from said give direction (104). The method further includes filtering the signal in both channels using high frequency (HF) cut means (108), and setting the filter characteristics of the HF-cut filter means (106).

The left and right channel signals may be processed by transaural crosstalk cancellation means (110) in order to give loudspeaker compatible signals. The HF-cut filter means may be convolved with an HRTF (107) in order to produce a modified HRTF.

The embodiments described above may be implemented, for example, by either: (1) a serial HF-cut filter, operating with the standard HRTF set; or (2) a modified HRTF filter set may be created by convolving each of the HRTF filters for placing virtual sounds in the rearward hemisphere with its respective HF-cut filter; or (3) individual modified HRTF-pairs may be used on their own, for example in the simulation of a multiple channel surround sound system, such as AC-3 5.1.

The embodiments of the invention may be implemented by way of a computer program.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method of processing a single channel audio signal to provide an audio signal having left and right channels corresponding to a virtual sound source at a given direction in space relative to a preferred position of a listener in use, the space including a forward hemisphere and a rearward hemisphere relative to said preferred position, the information in the channels including cues for perception of the direction of said single channel audio signal from said preferred position, the method including the steps of:

i) providing a two channel signal having the single channel audio signal in each of the two channels; and ii) binaural processing the two channel signal-using one of a plurality of bead response transfer functions (HRTF) to provide a right signal in one channel for the right ear of a listener and a left signal in the other channel for the left ear of the listener, wherein the binaural processing of the two channel signal is augmented using high frequency (HF)-cut filtering for virtual source positions in the rearward hemisphere, the amount of the HF-cut filtering being settable according to the given direction of the virtual sound source relative to said preferred position and wherein the amount of HF cut filtering decreases as the given direction approaches the forward hemisphere.

2. A method as claimed in claim 1 in which the amount of HF-cut filtering is at a maximum for virtual sound sources placed directly behind the preferred position of the listener, that is, at a direction of azimuth ±180° and elevation 0° relative to the preferred position of the listener, and the amount of HF-cut filtering progressively decreases as the forward hemisphere is approached.

3. A method as claimed in claim 1 in which the left and right channel signals are processed by transaural crosstalk cancellation means in order to give loudspeaker compatible signals.

4. A method as claimed in claim 1 in which the degree of HF-cut filtering is determined by filter coefficients set according to a function of the angle of azimuth and the angle of elevation of the virtual sound source.

5. A method as claimed in claim 1 in which the amount of HF-cut filtering is substantially the same for virtual sound sources placed at positions on the rear hemisphere which are equidistant from azimuth ±180° and elevation 0° relative to the preferred position of the listener.

6. A method as claimed in claim 1, in which the degree of HF-cut filtering is determined by filter coefficients set via a look-up table.

7. A method as claimed in claim 1 in which the HF-cut filtering is performed in series with an HRTF.

8. A method as claimed in claim 1 in which an HRTF is convolved with an HF-cut filter to produce a modified HRTF.

9. Apparatus for performing the method as claimed in claim 1, including signal processing means, HRTF filter means, HF-cut filter means, and a means for determining HF-cut filter coefficients as a function of the direction of the virtual sound source.

10. The method as recited in claim 1 wherein the amount of HF cut filtering is substantially the same for each of the left and right channels.

11. A method of processing a single channel audio signal to provide an audio signal having left and right channels corresponding to a virtual sound source at a given direction in space relative to a preferred position of a listener in use, the space including a forward hemisphere and a rearward hemisphere relative to said preferred position, the information in the channels including cues for perception of the direction of said simple channel audio signal from said preferred position, the method including the steps of:

i) providing a two channel signal having the single channel audio signal in each of the two channels; and ii) binaural processing the two channel signal-using one of a plurality of head response transfer functions (HRTF) to provide a right signal in one channel for the right ear of a listener and a left signal in the other channel for the left ear of the listener, wherein the binaural processing of the two channel signal is augmented using high frequency (HF)-cut filtering for virtual source positions in the rearward hemisphere, the amount of the HF-cut filtering being settable according to the given direction of the virtual sound source relative to said preferred position and wherein there is zero HF-cut filtering for virtual sound sources placed at directions of azimuth between 0° and ±90° relative to the preferred position of the listener.

12. A software product, comprising:

a computer readable medium having stored thereon a computer program for implementing a method of processing a single channel audio signal to provide an audio signal having left and right channels corresponding to a virtual sound source at a given direction in space relative to a preferred position of a listener in use, the space including a forward hemisphere and a rearward hemisphere relative to said preferred position, the information in the channels including cues for perception of the direction of said single channel audio signal from said preferred position, the method including the steps of:

i) providing a two channel signal having the single channel audio signal in each of the two channels; and ii) binaural processing the two channel signal using one of a plurality of head response transfer functions (HRTF) to provide a right signal in one channel for the right ear of a listener and a left signal in the other channel for the left ear of the listener, wherein the binaural processing of the two channel signal is augmented using high frequency (HF)-cut filtering for virtual source positions in the rearward hemisphere, the degree of the HF-cut filtering being settable according to the given direction of the virtual sound source relative to said preferred position and wherein the amount of HF cut filtering decreases as the given direction approaches the forward hemisphere and is substantially the same for each of the left and right channels.

13. An audio signal, comprising left and right channels corresponding to a virtual sound source at a given direction in space relative to a preferred position of a listener in use, the space including a forward hemisphere and a rearward hemisphere relative to said preferred position, information in the channels including cues for perception of the direction of a single channel audio signal from said preferred position, wherein said audio signal is processed from the single channel audio signal in accordance with the steps of:

i) providing a two channel signal having the single channel audio signal in each of the two channels; and ii) binaural processing the two channel signal using one of a plurality of head response transfer functions (HRTF) to provide a right signal in one channel for the right ear of a listener and a left signal in the other channel for the left ear of the listener, wherein the binaural processing of the two channel signal is augmented using high frequency (HF)-cut filtering for virtual source positions in the rearward hemisphere, the degree of the HF-cut filtering being settable according to the given direction of the virtual sound source relative to said preferred position and wherein the amount of HF cut filtering decreases as the given direction approaches the forward hemisphere and is substantially the same for each of the left and right channels.

14. An apparatus for producing an audio signal, comprising:

a signal processor;

an HRTF filter;

an HF-cut filter;

an HF-cut filter coefficient determining circuit which determines the HF-cut filter coefficients as a function of a virtual sound source;

wherein the audio signal is processed from a single channel audio signal to provide the audio signal having left and right channels corresponding to the virtual sound source at a given direction in space relative to a preferred position of a listener in use, the space including a forward hemisphere and a rearward hemisphere relative to the preferred position, information in the channels including cues for perception of the direction of the single channel audio signal from the preferred position;

wherein the apparatus provides HRTF filtering to modify a two channel signal having the same single channel signal in the two channels by modifying both of the channels using one of a plurality of head response transfer functions to provide a right signal in one channel for the right ear of a listener and a left signal in the other channel for the left ear of the listener, a time delay being introduced between the channels corresponding to the inter-aural time difference for a signal coming from said given direction; and wherein the signal in both channels is further filtered using said HF-cut filter for virtual sound source positions in the rearward hemisphere, the filter characteristics of which are settable according to the given direction of the virtual sound source and wherein the amount of HF cut filtering decreases as the given direction approaches the forward hemisphere and is substantially the same for each of the left and right channels.

* * * * *